US006233417B1

(12) United States Patent
Nakayama et al.

(10) Patent No.: US 6,233,417 B1
(45) **Date of Patent: *May 15, 2001**

(54) IMAGE FORMING APPARATUS

(75) Inventors: Yuji Nakayama, Yokohama; Koji Yamazaki, Odawara; Masaya Kawada, Mishima; Takaaki Kaya, Mishima; Hironori Owaki, Mishima, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,078

(22) Filed: Jul. 8, 1999

(30) Foreign Application Priority Data

Jul. 10, 1998 (JP) ..... 10-195807

(51) Int. Cl.[7] ..... G03G 15/00
(52) U.S. Cl. ..... 399/159; 430/56
(58) Field of Search ..... 399/159, 116, 399/161, 162; 430/56, 66, 67

(56) References Cited

U.S. PATENT DOCUMENTS 4,551,406 * 11/1985 Schaedlich et al. ..... 430/119
4,642,279 * 2/1987 Tanigami et al. ..... 430/66
4,650,736 * 3/1987 Saitoh et al. ..... 430/57
4,797,336 * 1/1989 Honda et al. ..... 430/57
5,943,531 * 8/1999 Takai et al. .

FOREIGN PATENT DOCUMENTS 0785475 7/1997 (EP) .
0809153 11/1997 (EP) .
53-092133 * 8/1978 (JP) .
6-274079 9/1994 (JP) .
7-010488 1/1995 (JP) .
7-219245 * 8/1995 (JP) .
8-129266 5/1996 (JP) .

* cited by examiner

*Primary Examiner*—Robert Beatty
(74) *Attorney, Agent, or Firm*—Fitzpatrick, Cella, Harper & Scinto

(57) ABSTRACT

An image forming apparatus which largely improves the reliability of electrophotographic apparatuses and can accommodate their extremely large productivity comprises an image forming part which forms toner images on an image carrying member, an image transfer part which transfers the toner images on the image carrying member onto a transfer material, and a cleaning part which removes post-transfer residual toner left on the image carrying member after the images are transferred onto the transfer material by the image transfer part, wherein the image carrying member is an amorphous silicon photosensitive member and an initial average gradient Δa of the photosensitive member is 0.0001 to 0.005.

14 Claims, 3 Drawing Sheets

IMAGE FORMING APPARATUS

BACKGROUND OF THE INVENTION

1. Field of the Invention

The present invention relates to an image forming apparatus and, more particularly to, an image forming apparatus that has amorphous silicon photosensitive members.

2. Related Background Art

Recently, there have widely accepted in the market such composite apparatuses that are provided with all the output terminals such as a copy machine, a printer, a facsimile etc. That is, those electrophotographic apparatuses have been widely employed as network accommodating output terminals. In the utilization of those output terminals, their duty cycle is thought of as an important parameter. The duty cycle, which refers to the limit number of sheets over which the body can continue to work without maintenance, has a life of the photosensitive drum as its largest rate-determining factor. In addition, from the viewpoint of ecology, it has become an important object to eliminate waste as much as possible or to reduce consumables, to elongate their life, and to improve their reliabilities. Moreover, with conventional analog devices largely having been converted into digital ones, it is now required to provide an analog-device equivalent costs or less.

With the above as a background, as image carrying members, amorphous silicon photosensitive members have largely been employed gradually as being indispensable in particular in the high-speed machines, which require high reliabilities, because of their large hardness (1000 kg/m$^2$ or higher of JIS-standard Vickers hardness), high durability, high heat resistance, and excellent ecological stability.

In such apparatuses, however, not only toner but also minute paper particles occurring from paper utilized mostly as a transfer material and resultantly-separated organic substances, and corona products and other foreign matter created by the existence of the built-in high-tension members will adhere to the surfaces of the image carrying member and adversely affect the picture quality; in high-humidity environments, moreover, such foreign matter may possible reduce the resistance to prevent the formation of clear electrostatic latent images, thus deteriorating the picture quality.

It is known that such picture-quality deteriorating phenomena are likely to occur with amorphous silicon photosensitive members, which form films due to glow discharge decomposition of silane and the like substances. To avoid such problems, especially when one-component magnetic toner is used, it is proposed that in a cleaning apparatus, as viewed in the travel direction of the image forming member, a magnet roller should be arranged on the upstream side of the cleaning blade to make a magnetic brush of some of toner collected into the cleaning apparatus, which brush be in turn brought in contact with the surface of the image forming member to re-supply magnetic toner so that the toner particles on the blade side may, by their abrasive action, remove the above-mentioned various kinds of foreign matter by sliding operation. Such a method will have a less local unevenness of the abrasive action on the image carrying member surface and a smaller deterioration of that surface than such an approach that a web or rubber roller polish, by sliding, that surface with abrasives. According to the above-mentioned method, with a heater being provided on the image carrying member, an attendant method may be employed that lowers the surrounding humidity even during stand-by operation at night, so as to prevent the resistance of the surface of the image carrying member from decreasing, thus blocking to some extent the deterioration in the picture quality due to the earlier mentioned factors.

In an image forming apparatus that repeats a process of transferring onto a transfer material mainly made of paper a transferable toner image formed on the image carrying member surface, the residual toner on the image carrying member needs to be removed for each process without shifting it onto the transfer material.

To this end, among many proposals made so far, such a cleaning method is widely used that a cleaning blade made of urethane rubber or other elastic materials is used to dust away the above-mentioned residual toner, because it has a simple and compact configuration with lower costs and is excellent in performance of removing toner. As the rubber material for the cleaning blade, urethane rubber is generally used for its high hardness, good elasticity, good wear-resistance, high mechanical strength, good oil-resistance, high ozone-resistance etc.

However, from a viewpoint of further energy saving requirements in recent years, there is a strong need to eliminate the heater provided on the image carrying member.

Possible factors for image smearing include toner, minute paper particles generated from paper used mostly as a transfer material, the resultantly deposited organic substances, and such components as nitric ions given as a result of oxidation of nitrogen in the air at the same time as the generation of various kinds of metal oxides and oxidized compounds generated at the corona discharge with high energy from build-in high tension members, which all attach to the surface of the image carrying member as it is used to form thin films (hereinafter called filming membrane) on the photosensitive member surface, thus absorbing the humidity in the high humidity environments to lower the resistance and prevent the formation of clear electrostatic latent images, which leads to the deterioration of the picture quality.

The above-mentioned filming membrane layer has been confirmed to measure in thickness about 30 to 80 Å by an optical method in our experiments. In our experiments of durability test conducted in this case, however, it has been found that the above-mentioned filming membrane initially measured in thickness about 30 to 80 Å and then changed little but as time passes, the image deterioration, which could have initially been eliminated by dry-wiping, water-wiping, or alcohol-wiping, cannot be done so. It has been found that in some cases the drum surface which has undergone the durability test to some extent in such a state cannot sufficiently be freed from image deterioration, unless it is polished with abrasive grains of 0.3 to 2.0 $\mu$m cerium oxide ($CeO_2$) dispersed in alcohol. This phenomenon is likely to occur especially when no drum heater is provided. With further discussion, we observed the surface of a photosensitive member having a variety of surface geometry both in the initial state and after the durability test using an atomic force microscope (AFM). After the durability test, the photosensitive member surface appeared to be almost flat as a result of wear as compared to that in the initial state. We conducted heating or ultra-sonic cleansing on the photosensitive member surface after the durability test, using an organic solvent (MEK, peroxodisulfuric sodium ($Na_2S_2O_8$)). Then, it was found that the amount of the filming at in particular the recess varies with the initial average gradient $\Delta a$ of the photosensitive member and, there is a corresponding correlation in the occurrence of the image smearing. As mentioned above, when no drum heater is installed, it is important to devise an image forming apparatus that forms no filming membranes from the initial state by use of the image carrying member and, among them, to provide the drum surface with the above-mentioned function.

Second, our experiments have shown that as the image carrying member is used on, the friction between the drum and the post-transfer residual toner given by the cleaning blade is increased.

This is considered to have been caused by a fact that the filming membrane increases the contact degree between the cleaning blade and the drum surface and also that between the post-transfer residual toner and the drum surface, thus increasing the friction.

An increase in friction is considered to increase the shearing stress of the cleaning blade, that among toner, and that in the vicinity of the drum surface. As a result, this is considered to lead to the chipping of the cleaning blade, the occurrence due to increases in the amount of heat generated by increases in the permanent strain shearing stress and also increases in the fatigue wear due in increases in the intra-drum stress.

Third, recently the image forming apparatus has not only been used as a copy machine but also as a printer widely. In addition, the apparatus has been provided with such application functions as feeding functions and sorting functions, so that its one job can continuously process 4000 sheets or more of paper. This means, for example, it is just estimated that an apparatus for 50 sheets/A4 size can operate for 80 minutes or more. In such a situation, the ambient temperature is considered to rise up to near 50° C. near the photosensitive member and higher at the butting (nipping) part between the cleaning blade and the photosensitive member. Therefore, it is considered that melt-adhesion frequently occurs on the photosensitive member.

Fourth, the cleaning blade has been determined in terms of its cleaning latitude by the butting angle against the drum surface, the free length, the thickness, the total pressure, the linear pressure, and the properties of rubber used as the cleaning blade. For example, Japanese Patent Application Laid-Open No. 6-274079 describes that in order to eliminate the chipping on the cleaning blade and the cleaning blade fluttering in the low-temperature and low-humidity environments, the peak temperature of tans should be at −13° C. to −16° C., the impact resilience should be higher, and the Young's modulus should be lower. However, it describes nothing about the impact resilience under the high-temperature region.

Our experiments conducted recently have shown that the above-mentioned toner melt-adhesion can be suppressed by the modulus of repulsion elasticity of the rubber material used as the cleaning blade.

Also, the causes of toner melt-adhesion on the drum is different between an amorphous silicon photosensitive member and an organic photosensitive member. In the case of an organic photosensitive member, toner melt-adhesion occurs because minute particles of an external additive such as silica are embedded into the photosensitive member surface to provide nucleuses, whereas in the case of an amorphous silicon photosensitive member, raining-state toner melt-adhesion occurs when there are few-μm-height protrusions on the photosensitive member surface or even when there are nothing that provide nucleuses.

However, rubber materials are largely temperature dependent and, urethane rubber used as the cleaning blade is particularly temperature-dependent.

SUMMARY OF THE INVENTION

Worked out to accommodate those problems, an object of the present invention is to largely improve the reliabilities of electrophotographic apparatuses by utilizing their photosensitive member surface not to generate image smearing even without drum heaters and their cleaning blade not to generate melt-adhesion and also to provide such an electrophotographic apparatus that can accommodate an extremely high productivity.

An another object of the present invention is to provide an image forming apparatus comprising an image forming part which forms toner images on a image carrying member, an image transfer part which transfers onto a transfer material the toner images on the image carrying member, and cleaning means which removes post-transfer residual toner left on the image carrying member after the images are transferred onto the transfer material by the image transfer-part, wherein the image carrying member is an amorphous silicon photosensitive member and the photosensitive member has an initial average gradient Δa of 0.0001 to 0.005. A still another object of the present invention is to provide an image forming apparatus, wherein the image carrying member has abnormally grown protrusions on its surface having a height of 5.0 μm or less, wherein the photosensitive member has a wear rate in an actual service condition of 0.01 Å/1000 revolutions to 2.0 Å/1000 revolutions, wherein the cleaning means is an elastic blade which has a modulus of repulsion elasticity of 45% or less at 45° C. and also a temperature dependency of the modulus repulsion elasticity of 0%/° C. to +1%/° C. in a temperature range of 5° C. to 60° C. and in a range where its properties exhibit rubbery state, wherein the width of abutting (nip width) of the cleaning blade against the drum surface is 5 μm to 60 μm, or wherein the toner has an average particle diameter of 6 μm to 8 μm and comprises solid wax of 0.2 to 20 parts by weight and magnetic particles of 10 to 200 parts by weight based on a binding resin, having a glass transition temperature of 40 to 60° C., of 100 parts by weight.

By an image forming apparatus according to the present invention comprising an image forming part which forms toner images on an image carrying member, an image transfer part which transfers the above-mentioned toner images on the above-mentioned image carrying member onto an transfer material, and a cleaning means which removes post-transfer residual toner left on the above-mentioned image carrying member after images are transferred onto the above-mentioned transfer material by the above-mentioned image transfer part, the initial average gradient Δa of the above-mentioned photosensitive member of 0.0001 to 0.005 improves the reliabilities for image smearing without the surface resistance being lowered due to higher humidity. We used an atomic force microscope (AFM) to observe the surfaces of the photosensitive member with various surfaces before, i.e. in the initial state, and after endurance, i.e. after it has used. After endurance, as compared to the initial state, the photosensitive member surfaces after endurance seemed almost smooth. We conducted ultrasonic cleaning on the photosensitive member surfaces after endurance using an organic solvent (MEK, sodium peroxodisulfate ($Na_2S_2O_8$)). Then, for the initial average gradient Δa of the photosensitive member of 0.005 or less, after endurance no image smearing was found and no large changes were found on the drum surfaces between before and after the cleaning by an organic solvent. For the initial average gradient Δa of 0.005 or higher, in the course of endurance, image smearing occurred and large changes were found on the drum surfaces between before and after the cleaning by an organic solvent.

This is taken that a large value of Δa will cause filming membranes to be formed in the recess in the surface, leading to image smearing.

When Δa is less than 0.001, toner melt-adhesion is apt to occur on the drum surfaces.

According to the present invention, the reliabilities can be improved by using a cleaning blade material that has a modulus of repulsion elasticity of as low as 45% or less at 45° C. and its temperature dependency of 0%/° C. to 1%/° C.

As for the above cases, the causes for toner melt-adhesion on the drum surface is different between an amorphous silicon photosensitive member and an organic photosensitive member. On an organic photosensitive member, minute particles of an external additive such as silica are embedded into the photosensitive member surface to provide nucleuses, thus giving rise to toner melt-adhesion, whereas on an amorphous silicon photosensitive member, raining-state toner melt-adhesion occurs when there are few-μm-height protrusions on the photosensitive member surface or even when there are nothing which provide nucleuses. In the former case of melt-adhesion, in particular, it was found that no melt-adhesion occurs when the height of the protrusions is 5 μm or less even with an average particle diameter of 6 μm. In the latter case of melt-adhesion, it was found that there is correlation between itself and the modulus of repulsion elasticity of the blade material. The modulus of repulsion elasticity at a normal measurement temperature of 23° C. is different from that of the actual apparatus in the actual service conditions. As we discussed further, it has found that by reducing the temperature-dependency of the modulus of repulsion elasticity, it is possible to prohibit toner melt-adhesion from occurring against fluctuations due to variations in the ambient temperature and a temperature rise caused by continuous feeding of paper.

FIG. 1 shows a region of melt-adhesion occurrence against temperature and modulus of repulsion elasticity. In FIG. 1, a member 1 has a higher value of modulus of repulsion elasticity (%) than the simultaneous value of temperature (° C.), so that melt-adhesion occurs. A member 3, at which no melt-adhesion occurs at 25° C. or so, has melt-adhesion occurrence at high temperatures due to a high change rate of the modulus of repulsion elasticity (%) against a change rate of the temperature (° C.). The cleaning blade rubber material becomes higher in elasticity as the temperature rises. If, when post-transfer residual toner is removed, there are local post-transfer residual toner left because the blade rubber material has become highly elastic due to a temperature rise, the load fluctuations occur, so that the cleaning blade edge is easily freed from the post-transfer residual toner. Resultantly, it is considered that such toner that cannot instantaneously cleaned by the cleaning blade edge becomes nucleuses, thus leading toner melt-adhesion. Those factors are considered to cause toner melt-adhesion when the modulus of repulsion elasticity is high.

According to the present invention, even when the total pressure is increased, the nip width only increases without increasing the surface pressure. In this case, when the nip width is 60 μm or more, the filming membranes are often stacked from the initial state. This is considered because the cleaning blade does not securely abut the photosensitive member but abuts it loose, i.e. the pressure distribution against the cleaning blade becomes broad. If the nip width is 10 μm or less on the other hand, the part component tolerance is critical, so that nips cannot be formed locally, giving rise to insufficient cleaning. If the nip width is 10 to 60 μm, it is possible to prohibit the formation of filming membranes which give poor images.

Also, by increasing the surface pressure ($g/mm^2$) as against the drum surface of the cleaning blade, it is possible to prohibit the formation of filming membranes. Specifically, at 100 $g/mm^2$ or more, the above-mentioned effects are conspicuous. At 400 $g/mm^2$ or more, however, rupture may occur due to too large shearing stress of the blade material. Also, the strength of the supporting members becomes critical, resulting in malfunctioning of the apparatus itself in some cases.

DESCRIPTION OF THE PREFERRED EMBODIMENTS

Specific preferred embodiments of the present invention are described in detail with reference to the drawings.

(Treatment Related to Making Photosensitive Members According to the Present Invention)

Charge-injection blocking layers and photoconductive layers were stacked on a cylindrical conductive substrate using a plasma CVD apparatus under such conditions as listed in Table 1 and then a surface layer is deposited as thick as 0.6 μm under such conditions as listed in Table 2, to make a light-receiving member, which serves as an image carrying member.

Figure 1:
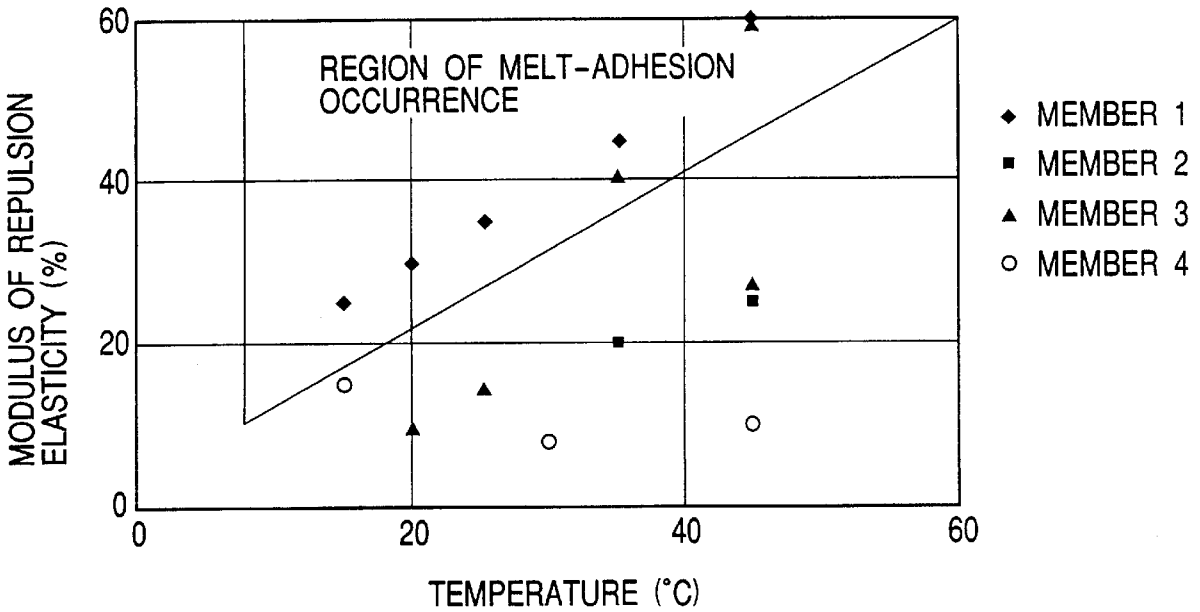
FIG. 1 shows an example of relationship between melt-adhesion occurrence and temperature and modulus of repulsion of elasticity.
Figure 2:
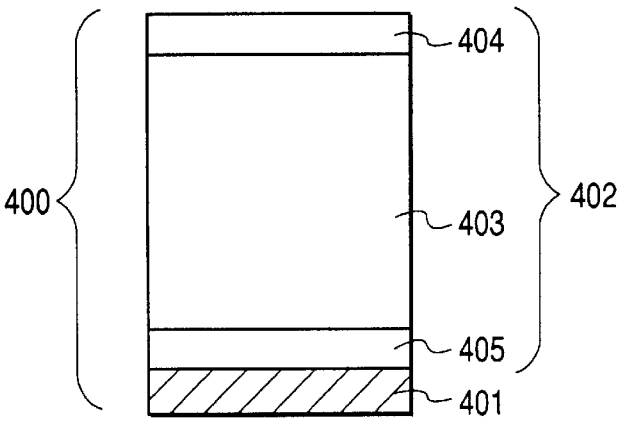
FIG. 2 is a schematic cross-sectional view of an example of a layer configuration of a photosensitive member.

FIG. 2 shows an example of a schematic cross-sectional view of a light-receiving member according to the present invention.

The a-Si light-receiving member shown in FIG. 2 comprises a photosensitive layer 402 having on it a photoconductive layer 403 made of an amorphous material containing at least silicon atoms stacked on a conductive substrate 401 made of aluminum etc. and, on top of that, a surface layer 404 made of a-C:H film or a-SiC:H film containing carbon and hydrogen atoms, although in the figure shows an example of providing a charge-injection blocking layer between the conductive substrate 401 and the photoconductive layer 403.

Although a light-receiving member may be deposited by a well known plasma CVD method, it is preferred to supply a high-frequency power of 1 MHz to 450 MHz from a high-frequency power supply to produce high-frequency glow discharge, thus improving the performance of cleaning the surface layer.

TABLE 1

| Conditions for making light-receiving member | | |
|---|---|---|
| Charge-injection | $SiH_4$ | 300 sccm |
| | $H_2$ | 500 sccm |

TABLE 1-continued

| Conditions for making light-receiving member | | |
|---|---|---|
| blocking layer | NO | 8 sccm |
| | $B_2H_6$ | 2000 ppm |
| | Power | 100 w (13.56 MHz) |
| | Inner pressure | 53.2 Pa (0.4 torr) |
| | Film thickness | 1 $\mu$m |
| Photoconductive layer | $SiH_4$ | 500 sccm |
| | $H_2$ | 500 sccm |
| | Power | 400 w (13.56 MHz) |
| | Inner pressure | 26.6 Pa (0.5 torr) |
| | Film thickness | 25 82 m |

TABLE 2

| Conditions for making surface layer | |
|---|---|
| $SiH_4/CH_4$ | (A) 10 sccm/500 sccm |
| | (B) 10 sccm/600 sccm |
| | (C) 10 sccm/700 sccm |
| | (D) 30 sccm/300 sccm |
| Power | 150 w (13.56 MHz) |
| Inner pressure | 39.9 Pa (0.3 torr) |
| Substrate temperature | 250° C. |

TABLE 3

| Conditions for making surface layer | |
|---|---|
| $SiH_4/CH_4$ | 20 sccm/300 sccm |
| Power | (E) 50 w (13.56 MHz) |
| | (F) 100 w (13.56 MHz) |
| | (G) 150 w (13.56 MHz) |
| | (H) 250 w (13.56 MHz) |
| Inner pressure | 39.9 Pa (0.3 torr) |
| Substrate temperature | 270° C. |

TABLE 4

| Light-receiving member | Surface roughness (Ra(nm)) | Initial Average Gradient (Δa) |
|---|---|---|
| A | 15.6 | 0.004 |
| B | 19.2 | 0.005 |
| C | 20.9 | 0.007 |
| D | 32.7 | 0.010 |
| E | 16.3 | 0.009 |
| F | 12.6 | 0.006 |
| G | 14.1 | 0.004 |
| H | 10.6 | 0.003 |

EXAMPLES

The following describes Examples of the present invention as referring to the drawings.

Example 1

Figure 3:
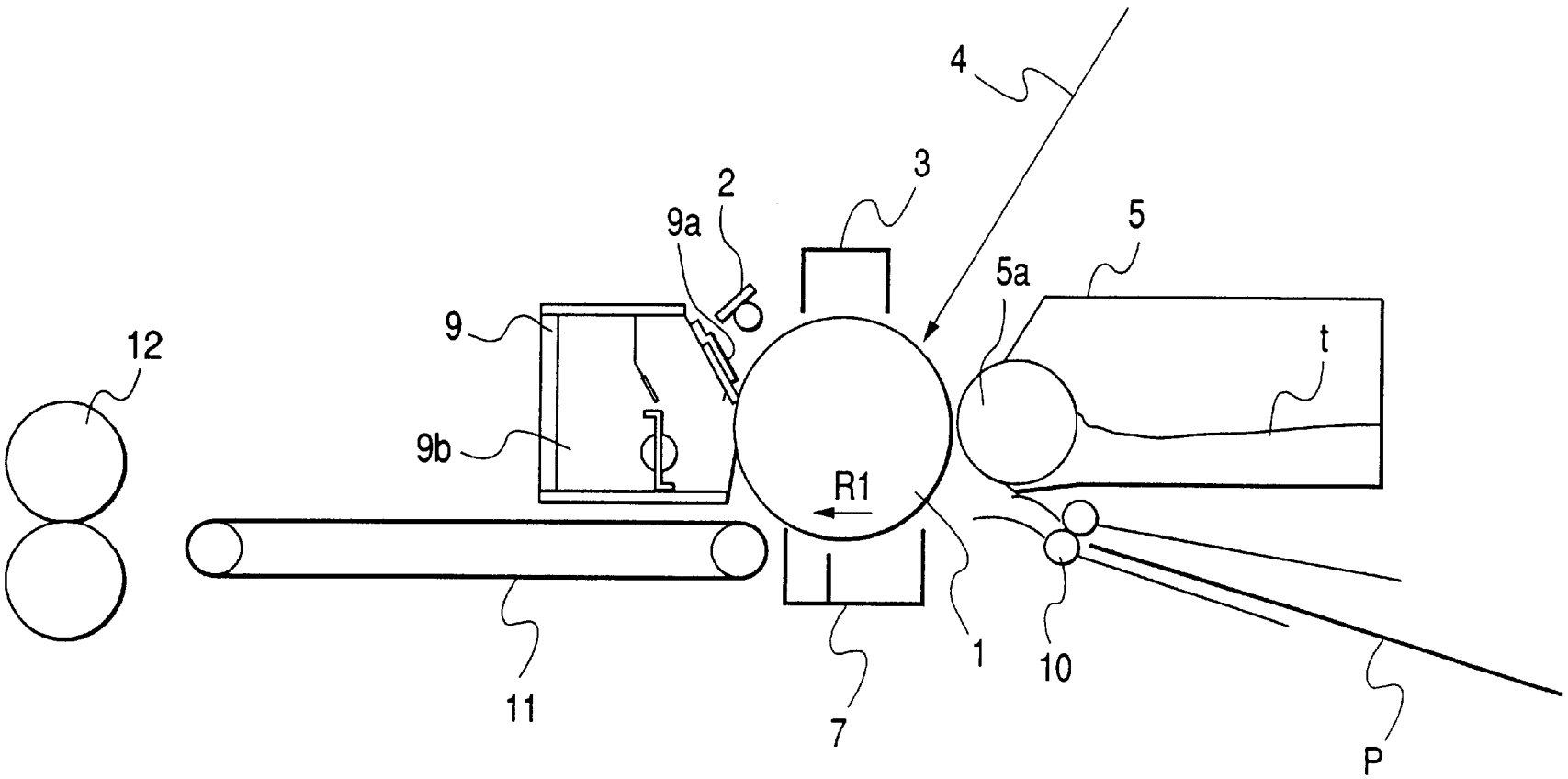
FIG. 3 is a schematic illustration to explain the block configuration of an electrophotographic apparatus.
Figure 4:
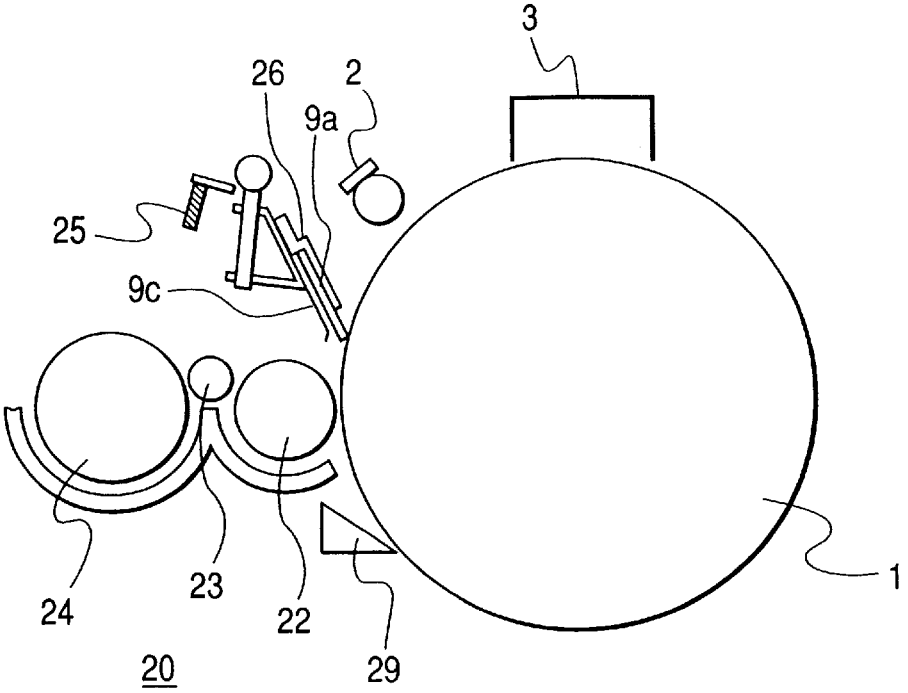
FIG. 4 and FIG. 5 are schematic illustrations to explain an example of a cleaning apparatus of respective electrophotographic apparatuses.

First, as referring to FIGS. 3 and 4, the general configuration of an electrophotographic apparatus is described as an example of an image forming apparatus related to the present invention.

FIG. 3 is a cross-sectional view of the basic configuration of an electrophotographic apparatus, in which reference numeral 1 indicates a drum shaped amorphous silicon photosensitive member which is rotated and driven at a prescribed speed in the direction of illustrated arrow R1 and around which are arranged a pre-exposure apparatus 2, a primary charger 3, a developing apparatus 5, a transfer separating charger 7, and a cleaning apparatus 9. The cleaning blade 9*a* of the above-mentioned cleaning apparatus 9 is made of urethane rubber having a thickness of 2 mm.

The primary charger 3, a developing sleeve 5*a* and the transfer separating charger 7 are connected with a high-voltage power supply (not shown). Also, the photosensitive member 1 and the developing sleeve 5*a* have each a drive motor (not shown) and rotated and driven independently of each other thereby.

Next, how to form images by the present electrophotographic copy machine is explained.

As the photosensitive member 1 is rotated at a prescribed speed in the illustrated arrow direction, its surface is static-eliminated by the pre-exposure apparatus 2 and then charged uniformly by the primary charger 3. Next, when the surface of the photosensitive drum 1 is irradiated with image exposure light 4 (laser beam, peak wavelength=653 nm), it has, formed on it, an electrostatic latent image which corresponds to a given image, which is then developed by the developing apparatus 5 to become conspicuous as the toner image.

At the same time, a transfer material P is fed onto a resist roller 10 by a carrying system (not shown) and then sent at appropriate timing by the resist roller 10 to a transfer nip part between the photosensitive drum 1 and the transfer separating charger 7, where the toner image on the photosensitive member 1 is transferred and then separated from the photosensitive member 1 by the action of the transfer separating charger 7.

The transfer material P thus separated from the photosensitive member 1 is sent by the carrying apparatus 11 to a fixing apparatus 12 to fix the transfer material P with the toner image transferred.

Incidentally, the maximum image width for an electrophotographic copy machine related to the present embodiment is about 290 mm, the width of a A4-size paper, and the drum's peripheral speed is 300 mm/sec.

The photosensitive member 1 is made of an about 3 mm thick aluminum cylinder, on which a 30 $\mu$m thick amorphous silicon photosensitive layer is formed by the glow discharge. As the surface layer of the photosensitive member, SiC:H was stacked as thick as 800 Å.

The developing apparatus 5 has on its surface a developing sleeve 5*a* on which a coating layer containing a mixture of phenol resin, graphite, and carbon is formed and in itself, toner t which serves as a developer.

The developing sleeve 5*a* is driven at a relative speed 150% in a forward direction with the photosensitive member 1, with the gap therebetween being set at 230 $\mu$m. To coat the toner t on the developing sleeve 5*a*, a magnetic blade is used, with the gap therebetween set at 280 $\mu$m, in which state, a square wave having peak-to-peak voltage of 1400 V, a frequency of 2700 Hz, and a duty ratio of 35% to which a direct current is superimposed is applied to the developing sleeve 5*a*.

In addition, to a cleaning vessel 9*b* of the cleaning apparatus 9 is held a cleaning blade 4 which is abutted against the surface of the photosensitive member 1.

FIG. 4 is a schematic cross-sectional view of the cleaner part, wherein a cleaning blade 9*a* is an elastic blade mainly made of urethane having a hardness of 70 degrees (Hs), a modulus of repulsion elasticity of 15% (25% at 40° C.), 300% modulus 200 (kg/cm$^2$), all based on the JIS Standards, and is arranged on the photosensitive member 1 with an abutting angle of 24 degrees, an abutting pressure of 10 g/cm$^2$, and a surface pressure of 150 g/mm$^2$. The cleaning blade 9*a* has a sheet thickness of 2 mm, with a member 9*c*SUS (sheet thickness=1.0) attached as a back plate. The cleaning blade has a free length of 3 mm. On the upstream side (as viewed in the rotation direction of the photosensitive member 1) of the cleaning blade 4 in the cleaning vessel 24, an elongated magnet roller 22 is formed perpendicular to the paper of FIG. 3 with a prescribed gap between itself and the photosensitive member 1. On the upstream side of the pre-exposure light of the cleaner, a separating claw 29 is arranged. The magnetic roller 22 rotates at a peripheral speed of relative speed 10% in a forward direction with the rotation direction of the photosensitive member 1. The pre-exposure light 2 is emitted from a light emitting diode mainly of a peak wavelength of 660 nm and has a half-band width of about 25 nm, which is ½ of the peak wavelength, and an exposure amount of 20 $\mu$J/cm$^2$. A distance between the pre-exposure light 2 and the primary charger 3 is about 50 mm/sec. The magnetic roller 22 rotates at a peripheral speed of relative speed 180% in a backward direction against the rotation direction of the photosensitive member 1. The magnetic roller 22 is arranged against the photosensitive member 1 with a gap of 1.0 mm therebetween. A restricting roller 23 is arranged against the magnetic roller 22 with a gap of 1.8 mm therebetween and rotates at a relative speed 180% in a backward direction against the magnetic roller 22. The pre-exposure light 3 is emitted from an emitting diode (made of GaAlAs) mainly of a 660 nm peak wavelength and has a half-band width of about 25 nm, which is half the peak wavelength, and an exposure amount of 10 $\mu$J/cm$^2$. A distance between the pre-exposure light 2 and the primary charger 3 is about 50 mm/sec.

As the toner t first, octagonal magnetic powder was used having an average particle diameter of 0.18 $\mu$m. One-component magnetic toner was used that the positive charging average particle diameter is 6.5 $\mu$m, the main binder is styrene-acryl copolymer, a magnetic substance of 100 parts by weight and a silica, inorganic powder, of 0.5 part by weight as an external additive were used, and the glass transition point is about 60° C. and, the charge quantity on its developing sleeve 5*a* is +3 to +12 ($\mu$C/g) and the coating quantity is 0.6 to 1.3 mg/cm.

A photosensitive member 1 of type A as used as listed in Table 2 and also that, as described in Japanese Patent Application Laid-Open No. 7-010488, an abrasive tape was used to polish spherical protrusions on the photosensitive member surface down to Rmax. 5 $\mu$m or less.

According to the present invention, after a durability test of an image output of 3 million sheets, no image smearing occurred even under the high-temperature, high-humidity (32.5° C./85%) environments. Also, no problems such as chipping occurred at the cleaning blade edges. After that durability test of 3 million sheets, the photosensitive member showed no melt-adhesion, partial filming membranes, no frictional damages etc. on images. The wear was 0.4 Å/1000 revolutions. The average gradient Δa of the photosensitive member after the 3-million-sheet test was 0.0001. Subsequently, the average gradient Δa of the photosensitive member turned out to be 0.0005 after it underwent heating in 5% of an aqueous solution of sodium peroxodisulfate (70 to 80° C., 30 minutes), ultra sonic cleaning (about 1 minute) in acetone, and rinsing with ethanol/pure water. The average gradient Δa was measured with an atomic force microscope (AFM: made by Digital Instruments, NannoSonic IIIa Dimension 3000/scanning mode, tapping mode/scanning scope: 200 $\mu$m×20 $\mu$m, probe: Si-cantilever). Note here that the average gradient Δa indicates an average gradient of irregular inclined surface at a prescribed length, in short, it corresponds to the average of tangent of a prescribed section.

Thus obtained 3-dimensional measurements were calculated according to the definition described in pp. 8–12 of Chapter 8 "Definition of Terms and Parameters for Surface Roughness" of Reference Manual for a surface roughness instrument SE-3300 made by Kosaka Research, Co. Ltd.

A reflection spectroscopy type interferometer (type MCDP2000 from Ohtsuka Densi Co. Ltd.) was also used to measure the film thickness, to find a 10 Å-thick filming layer. After the 3-million-sheet durability test, photosensitive members B, G, and H also showed no problems such as image smearing even under the high-temperature, high-humidity environments (32.5° C./85%). Also, no chipping at the cleaning blade edges was observed. After the 3-million-sheet durability test, the photosensitive member showed no problems such as melt-adhesion, partial filming membrane, frictional damages etc. on images.

Example 2

The same configuration was used as Example 1, except that a photosensitive member G was used and the cleaning blade was changed as follows.

Such a cleaning blade was arranged on the photosensitive member 1 that comes in an elastic blade mainly made of urethane and has a hardness of 77 degrees (Hs), a modulus of repulsion elasticity of 10% at 25° C. (20% even at 40° C.), a 300%-modulus of 250 kg/cm$^2$, all based on the JIS Standards, and also an abutting angle of 28 degrees, an abutting pressure of 20 kg/cm$^2$, and a surface pressure of 200 g/mm$^2$. According to the present invention, after the 3-million-sheet durability test, no image smearing occurred even under the high-temperature, high-humidity environments (32.5° C./85%). Also, after the 3-million-sheet durability test of the photosensitive member, no problems were observed such as melt-adhesion, partial filming membrane, poor cleaning, and frictional damages.

Example 3

Figure 5:
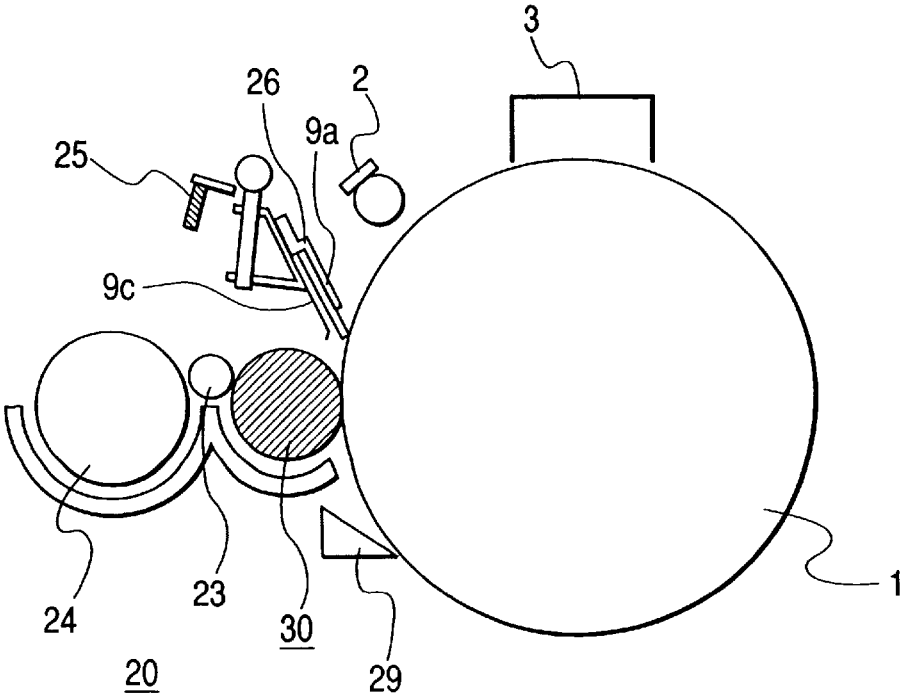

Almost the same configuration as Example 1 was used in this Example except for some changes, which are described as referring to FIG. 5. In place of the magnetic roller 22, a urethane-made sponge roller 30 was arranged. The urethane-made sponge roller 30 comprises an urethane sponge mounted as thick as 4.0 mm on a ϕ12 core bar, the sponge has a porosity of 0.60. The same cleaning blade was used as in Example 1. The urethane-made sponge roller is applied onto the photosensitive member 1 with a total pressure of 2.0 kgf and rotates at a peripheral speed of relative speed 25% in a forward direction with the rotation direction of the photosensitive member 1. After the 3-million-sheet durability test of the photosensitive member 1, no problems occurred such as melt-adhesion, partial filming membrane, poor cleaning, and frictional damages in images. The wear was 0.8 Å/1000 revolutions. Regarding the photosensitive members B, G and H, no image smearing was observed even under the high-temperature, high-humidity environments (32.5° C./85%) also even after the 3-million-sheet durability test. In addition, no chipping occurred at the cleaning blade edges. After the 3-million-sheet durability test, the photosensitive member 1 exhibited no problems such as melt-adhesion, partial filming membranes, and frictional damages.

Comparative Example 1

A photosensitive member D was used with the same configuration as in Example 1.

After about 0.5 million sheets of durability test was conducted under the high-temperature, high-humidity environments (32.5° C./85%), image smearing occurred in some cases. After the one-million-sheet test, the average gradient Δa of the photosensitive member was 0.001. Then, the photosensitive member underwent heating (70 to 80° C., 30 minutes) in 5% of an aqueous solution of sodium peroxodisulfate ($Na_2S_2O_8$) and ultra-sonic cleaning in acetone (about 1 minute) and also rinsing with ethanol/pure water, resulting in the average gradient Δa of the itself of 0.004. After the one-million-sheet test, the film thickness was measured with a reflection spectrometry type interferometer (type MCDP2000 from Ohtsuka Densi, Co., Ltd.) before and after cleaning, to make sure of a filming layer thickness of 80 Å. Also, photosensitive members C, E, and F were discussed and, as a result, image smearing was observed respectively after one-, 0.6-, and 1.2-million-sheet durability tests under the high-temperature, high-humidity environments (32.5° C./85%).

Comparative Example 2

The same configuration as Example 1 was used except for the material of the cleaning blade.

Such a cleaning blade was arranged on the photosensitive member 1 that comes in an elastic blade mainly made of urethane with a hardness of 73 degrees (Hs) and has a modulus of repulsion elasticity of 35% at 25° C. (67% even at 40° C.), a 300% modulus of 150 kg/cm$^2$, all based on the JIS Standards, and also has an abutting angle of 24 degrees, an abutting pressure of 10 kg/cm$^2$, and a surface pressure of 150 g/mm$^2$.

After about 50,000 sheets of durability test, melt-adhesion occurred in some cases. In addition, once it has occurred, melt-adhesion was lengthened and became numerous.

Comparative Example 3

Almost the same configuration was used as Example 3, except that the sponge roller was rotated at a peripheral speed of relative speed 50% in a forward direction with the rotation direction of the photosensitive member 1. A photosensitive member E was used.

After about 2-million-sheet durability test under the high-temperature, high-humidity environments (32.5° C./85%), no image smearing occurred. However, the surface layer had non-uniform breaks and also a defect as large as 8000 Å in it partially.

Also, the film thickness was measured with a reflection spectroscopy type interferometer (type MCDP2000 from Ohtsuka Densi, Co., Ltd.) and came up with a result that the wear was 2.4 Å/1000 revolutions.

Comparative Example 4

The same basic configuration was used as Example 2, except that there are abnormally grown protrusions as high as 8 μm on the photosensitive member 1. After about 30,000 sheets of paper were fed through, melt-adhesion occurred at the protrusions, while after 0.5 million sheets of paper were fed through, poor cleaning was observed at the protrusions.

According to the present invention, it is possible to employ such a geometry of photosensitive members as not to generate image smearing without drum heaters and also such a cleaning blade as not to generate melt-adhesion, to largely improve the reliability of the electrophotographic apparatus and also to provide such an electrophotographic apparatus that can accommodate extremely large productivity of its own.

What is claimed is:

1. An image forming apparatus comprising:

an image carrying member of an amorphous silicon photosensitive member, the image carrying member having 5.0 μm or less of a height of protrusions abnormally grown on its surface and having 0.01 Å/1000 revolutions to 2.0 Å/1000 revolutions of a wear rate of a surface layer of the image carrying member;

an image forming part which forms toner images on the image carrying member using a toner comprising a resin having an average particle diameter of 6 to 8 μm and having a glass transition temperature of 40° C. to 60° C. and a magnetic powder;

an image transfer part which transfers onto a transfer material the toner images on the image carrying member;

a cleaning part which removes post-transfer residual toner left on the image carrying member after the images are transferred onto the transfer material by the image transfer part; and a roller arranged in opposition to a surface of the image carrying member spaced between the cleaning part and the image transfer part.

2. The image forming apparatus according to claim 1, wherein the toner comprises 0.2 to 20 parts by weight of a solid wax and 10 to 200 parts by weight of the magnetic powder based on 100 parts by weight of the resin.

3. The image forming apparatus according to claim 1, wherein the cleaning part comprises a blade.

4. The image forming apparatus according to claim 3, wherein the blade is an elastic blade, and a modulus of repulsion elasticity of the elastic blade is 45% or less at 45° C. and a temperature-dependency of modulus of repulsion elasticity is 0%/° C. to +1%/° C. in a temperature range of 5° C. to 60° C. and also in such a range that properties of the elastic blade are of a rubbery state.

5. The image forming apparatus according to claim 3, wherein an abutting width (nip width) of the blade against a surface of the image carrying member is 5 μm to 60 μm.

6. The image forming apparatus according to claim 3, wherein the roller is arranged with a space between the roller and a surface of the image carrying member, and generates magnetic force.

7. The image forming apparatus according to claim 3, wherein the roller is arranged so as to be able to rotate in a forward direction with a rotation direction of the photosensitive member.

8. The image forming apparatus according to claim 3, wherein the roller is arranged so as to be applied onto a surface of the image carrying member with pressure.

9. The image forming apparatus according to claim 8, wherein the roller is a sponge roller.

10. An image forming apparatus comprising:

(a) an image forming part which forms toner images on an image carrying member;

(b) an image transfer part which transfers onto a transfer material the toner images on the image carrying member; and (c) cleaning means which removes post-transfer residual toner left on the image carrying member after the images are transferred onto the transfer material by the image transfer part, wherein the image carrying member (i) is an amorphous silicon photosensitive member and an initial average gradient Δa of the photosensitive member is 0.0001 to 0.005; and (ii) a wear rate of a surface layer of the image-carrying member in an actual service condition is 0.01 Å/1000 revolutions to 2.0 Å/1000 revolutions.

11. An image forming apparatus comprising:

(a) an image forming part which forms toner images on an image carrying member;

(b) an image transfer part which transfers onto a transfer material the toner images on the image carrying member; and (c) cleaning means which removes post-transfer residual toner left on the image carrying member after the images are transferred onto the transfer material by the image transfer part, wherein the image carrying member is an amorphous silicon photosensitive member and an initial average gradient Δa of the photosensitive member is 0.0001 to 0.005 and wherein the cleaning means is an elastic blade, and a modulus of repulsion elasticity of the elastic material is 45% or less at 45° C. and a temperature dependency of modulus of repulsion elasticity is 0%/° C. to +1%/° C. in a temperature range of 5 to 60° C. and also in such a range that properties of the elastic blade are of a rubbery state.

12. An image forming apparatus comprising:

(a) an image forming part which forms toner images on an image carrying member;

(b) an image transfer part which transfers onto a transfer material the toner images on the image carrying member; and (c) cleaning means which removes post-transfer residual toner left on the image carrying member after the images are transferred onto the transfer material by the image transfer part, wherein the image carrying member is an amorphous silicon photosensitive member and an initial average gradient Δa of the photosensitive member is 0.0001 to 0.005 and wherein the cleaning means is a cleaning blade and an abutting width (nip width) of the cleaning blade against a surface of the image carrying member is 5 μm to 60 μm.

13. An image forming apparatus comprising:

(a) an image forming part which forms toner images on an image carrying member;

(b) an image transfer part which transfers onto a transfer material the toner images on the image carrying member; and (c) cleaning means which removes post-transfer residual toner left on the image carrying member after the images are transferred onto the transfer material by the image transfer part, wherein the image carrying member is an amorphous silicon photosensitive member and an initial average gradient Δa of the photosensitive member is 0.0001 to 0.005 and wherein the toner has an average particle diameter of 6 to 8 μm and also comprises 0.2 to 20 parts by weight of solid wax and 10 to 200 parts by weight of magnetic powder based on 100 parts by weight of a binding resin having a glass transition temperature of 40 to 60° C.

14. The image forming apparatus of any of claims 10–13, wherein the image carrying member has surface protrusions and a height of the surface protrusions is 5.0 μm or less.

* * * * *

UNITED STATES PATENT AND TRADEMARK OFFICE

CERTIFICATE OF CORRECTION

PATENT NO. : 6,233,417 B1
DATED : May 15, 2001
INVENTOR(S) : Yuji Nakayama et al.

It is certified that error appears in the above-identified patent and that said Letters Patent is hereby corrected as shown below:

Column 1,
Line 9, "have" should read -- have been --;
Line 16, "limit" should read -- limited --;
Line 41, "possible" should read -- possibly --; and
Line 54, "be" should read -- may be --.

Column 2,
Line 43, "test" should read -- tests --;
Line 46, "little but" should read -- a little bit --;
Line 49, "surface" should read -- surface, --;
Line 50, "state" should read -- state, --; and
Line 65, "at in" should read -- , in -- and "recess" should read -- recess, --.

Column 3,
Line 7, "used on," should read -- used, --;
Line 12, "that" should be deleted;
Line 21, "in" (second occurrence) should read -- to --;
Line 44, "tans" should read -- tan $\delta$ --;
Line 53, "is" should read -- are --; and
Line 64, "are" should read -- is --.

Column 4,
Line 10, "An another" should read -- Another --;
Line 45, "an" should read -- a --; and
Line 56, "has" should read -- has been --.

Column 5,
Line 23, "are" should read -- is --;
Line 32, "has" should read -- has been --;
Line 49, "are" should read -- is --; and
Line 54, "cleaned" should read -- be cleaned --.

UNITED STATES PATENT AND TRADEMARK OFFICE

CERTIFICATE OF CORRECTION

PATENT NO. : 6,233,417 B1
DATED : May 15, 2001
INVENTOR(S) : Yuji Nakayama et al.

It is certified that error appears in the above-identified patent and that said Letters Patent is hereby corrected as shown below:

Column 6,
Line 51, "in" should be deleted.

Column 7,
Line 51, insert "(A little correlation between Ra and $\Delta$a)".

Column 8,
Line 40, "of an about" should read -- up of about a --.

Column 9,
Line 42, "mg/cm." should read -- mg/cm$^2$. --

Column 11,
Line 10, "the itself of" should read -- about --.

Signed and Sealed this

Fifth Day of March, 2002

*Attest:*

*Attesting Officer*

JAMES E. ROGAN
*Director of the United States Patent and Trademark Office*